US006024027A

United States Patent [19]

Esmaili

[11] Patent Number: 6,024,027

[45] Date of Patent: Feb. 15, 2000

[54] THROUGH THE WALL MOUNTING FOR ATM

[75] Inventor: Mahyar Esmaili, Canton, Ohio

[73] Assignee: Diebold Incorporated, North Canton, Ohio

[21] Appl. No.: 09/130,756

[22] Filed: Aug. 7, 1998

Related U.S. Application Data

[60] Provisional application No. 60/066,972, Nov. 28, 1997.

[51] Int. Cl.[7] ..... E05G 1/00

[52] U.S. Cl. ..... 109/50; 312/242; 312/222

[58] Field of Search ..... 109/50, 51, 58, 109/58.5; 312/242, 263, 265.5, 265.6, 222

[56] References Cited

U.S. PATENT DOCUMENTS

| | | | |
|---|---|---|---|
| 4,561,704 | 12/1985 | Smith | 312/222 |
| 5,020,450 | 6/1991 | Lichter | 109/50 |
| 5,788,348 | 8/1998 | Ramachandran et al. | 312/265.6 |
| 5,794,547 | 8/1998 | Dallman et al. | 109/50 |

*Primary Examiner*—Peter M. Cuomo
*Assistant Examiner*—Gerald A Anderson
*Attorney, Agent, or Firm*—Ralph E. Jocke

[57] ABSTRACT

An automated banking machine includes a housing (10) which is mounted through an opening (24) in a building wall (26). A fascia (32) is removably positioned in a front opening (14) of the housing. Fastening mechanisms (38) releasably hold the fascia in engagement with the housing. A surround (34) is releasably positioned to cover the fastening mechanisms. A latching mechanism for holding the surround in engagement with the housing includes interengaging posts (52) and key slots (40). A bolt (44) engages in an aperture (54) in the surround to prevent the surround from being removed unless the latching mechanism is disengaged.

20 Claims, 8 Drawing Sheets

THROUGH THE WALL MOUNTING FOR ATM

This application claims the benefit of U.S. Provisional Application No. 60/066,972 Nov. 28, 1997.

TECHNICAL FIELD

This invention relates to automated banking machines. Specifically this invention relates to a mounting arrangement for an automated banking machine in which the customer interface for the machine extends through a building wall or similar structure.

BACKGROUND ART

Automated banking machines are known in the prior art. A popular type of an automated banking machine is an automated teller machine (ATM). ATMs may be used to conduct banking transactions such as dispensing cash, making deposits and transferring funds between accounts.

To allow customers to conduct banking transactions after hours ATMs are sometimes mounted so that the user interface of the machine is accessible from the outside of a building. Such "through the wall" mounting enables users to conduct banking transactions in either drive-up or walk-up environments. When an ATM is mounted in this manner a portion of the machine extends through an opening in the wall. A user interface which includes input and output devices is accessible from the exterior of the wall.

Whenever ATMs are installed in a through the wall configuration there is always a risk of vandals attempting to damage the user accessible components. There is also occasionally failure of components in the user interface due to wear or exposure to the elements. When this occurs there is a need to remove all or a portion of the user interface to make necessary repairs. Generally the exterior portions of a user interface are not designed to be readily removable. As a result when the portions of the exterior customer interface need to be replaced there is often considerable effort involved.

There are also components within ATMs that require periodic servicing. Usually servicing is accomplished by opening one or more access doors on the machine. Generally these access doors are positioned on the side of the machine opposite the user interface, which is inside the building. While this arrangement provides for convenient servicing of most components, there are some components that could be more readily serviced from the opposite side of the machine. The difficulty associated with removing the user interface generally renders servicing components of the ATM in this manner impractical.

Thus there exists a need for an automated banking machine apparatus that can be mounted in a through the wall configuration which provides for more readily removing the fascia therefrom for purposes of replacing components on the fascia and for servicing components inside the machine, but which also minimizes the risk of unauthorized persons gaining access to the interior of the machine by removing the fascia.

DISCLOSURE OF INVENTION

It is an object of the present invention to provide an automated banking machine apparatus.

It is a further object of the present invention to provide an automated banking machine apparatus which has a through the wall mounting arrangement.

It is a further object of the present invention to provide an automated banking machine which has a fascia which is more readily removable by authorized persons, but which minimizes the risk of unauthorized access.

It is a further object of the present invention to provide an automated banking machine that provides enhanced service access.

It is a further object of the present invention to provide an automated banking machine which has a through the wall mounting arrangement which can be more readily, serviced by a single individual.

It is a further object of the present invention to provide a method of providing a through the wall mounting for an automated banking machine.

Further objects of the present invention will be made apparent in the following best modes for carrying out invention and the appended claims.

The foregoing objects are accomplished in a preferred embodiment of the invention by an automated banking machine. The machine has a first housing portion which extends through an opening in a building wall. The machine further includes a second housing portion that is positioned on an interior side of the building wall.

The machine further includes a fascia which serves as a user interface. The first housing portion includes a front opening. The fascia in the operative position extends in covering relation of the front opening. In the operative position of the fascia user actuatable components on the fascia are accessible by a user on an exterior side of the building wall. The fascia is held in releasable engagement with the first housing portion by fastening mechanisms. The fastening mechanisms have actuators that are accessible from the exterior side of the building wall.

A surround is releasably mounted on the exterior side of the building wall. The surround is configured so that in the operative position it overlies and covers the actuators of the fastening mechanisms. The surround is held in the operative position by a releasable latching mechanism. The latching mechanism includes an interengaging post and key slot arrangement. The latching mechanism further includes a movable bolt member which extends through an interior area of the machine.

In an operative position the bolt and post and key slot arrangement maintain the surround in a position covering the actuators of the fastening mechanism holding the fascia in engagement with the housing. Retracting the bolt enables the surround to be moved so that the actuators of the fastening mechanisms may be accessed. Once accessed, the fastening mechanisms may be released and the fascia removed. This enables the fascia and the components thereof to be readily replaced and serviced and the components in the housing accessed through the front opening by authorized personnel.

BEST MODES FOR CARRYING OUT INVENTION

Figure 1:
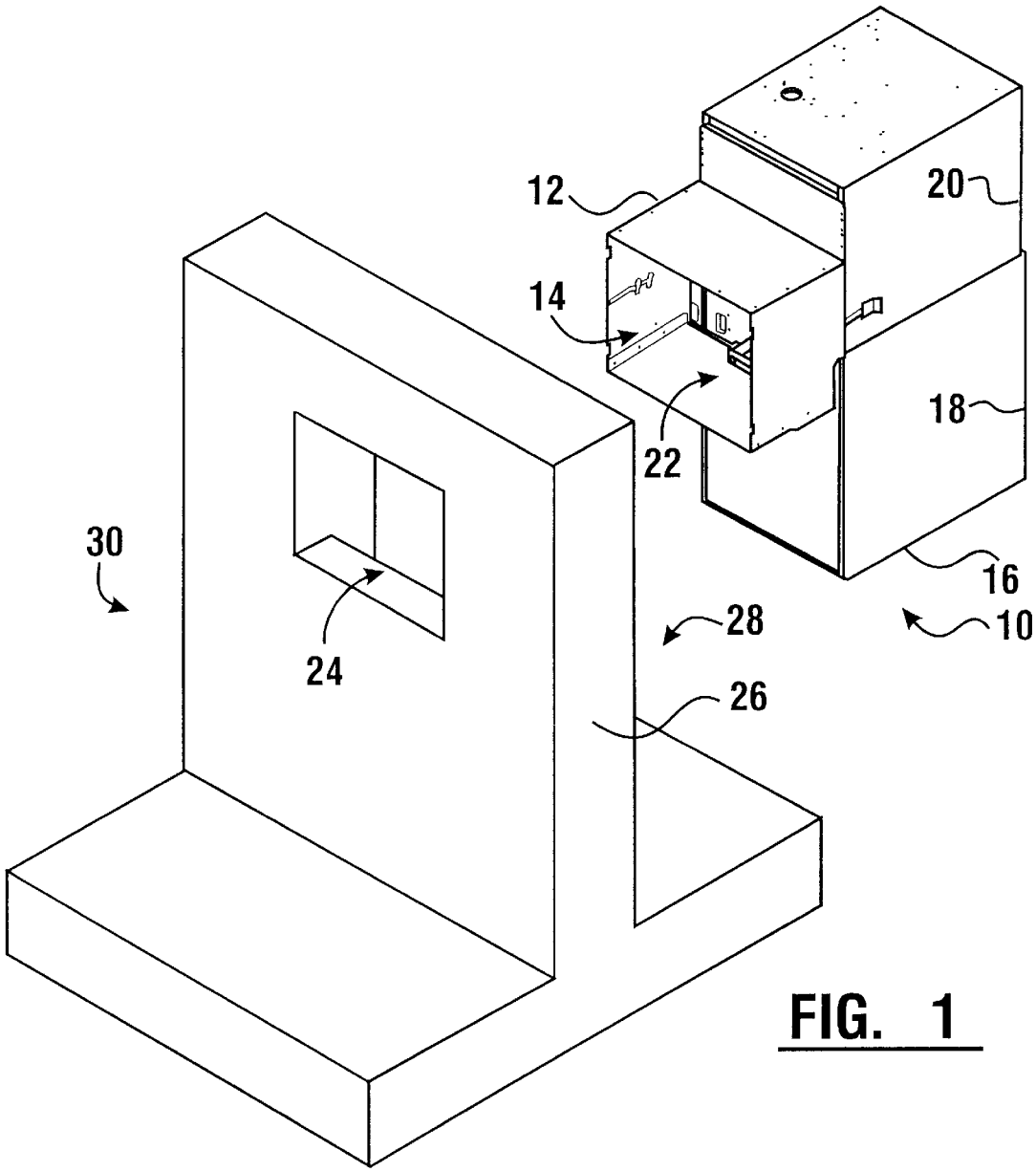
FIG. 1 is an isometric view of a housing of an automated banking machine and a building wall having an opening therein.

Referring now to the drawings and particularly to FIG. 1 there is shown therein a housing of an automated banking machine generally indicated 10. The housing includes a first housing portion 12. First housing portion 12 is a generally rectangular housing portion which has a front opening 14. Housing 10 further includes a second housing portion 16. Housing portion 16 in the preferred embodiment includes a chest 18 and an upper portion 20. It should be understood that housing portions 18 and 20 include access doors (not shown) which may be accessed by authorized personnel. This is done by opening locks or other security mechanisms.

Housing 10 of the automated banking machine bounds an interior area generally indicated 22. Interior area 22 includes serviceable components of the automated banking machine. These components may include for example currency dispenser mechanisms, deposit accepting mechanisms, computers and communications equipment, card reading devices, printers and displays. Of course other components may be housed within the housing depending on the type and functions carried out by the banking machine. Other automated banking machines may include mechanisms for dispensing or receiving checks, vouchers, stamps, tickets or other items of value. For purposes of the invention an automated banking machine shall be considered as including any transaction machine which is used to carry out transactions of value.

As indicated in FIG. 1 housing 10 is designed for mounting with housing portion 12 extending in an opening 24 in a building wall 26. Building wall 26 is preferably an interior or exterior wall of a bank building. Wall 26 separates an interior area generally indicated 28 from an exterior area generally indicated 30.

Figure 2:
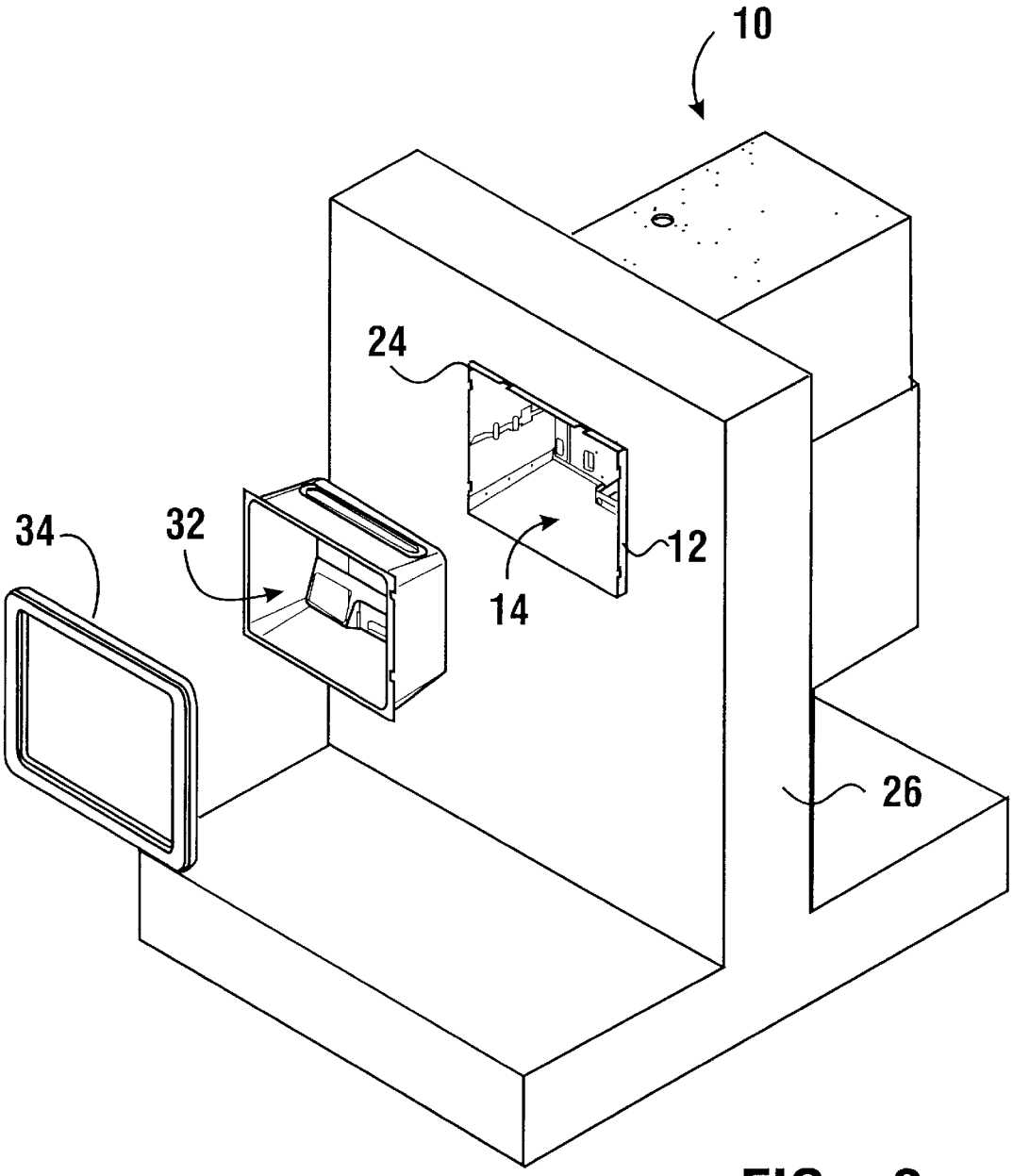
FIG. 2 is an exploded isometric view of a surround, fascia and housing of an automated banking machine mounted in a through the wall arrangement.

As shown in FIG. 2 housing 10 is preferably mounted with first housing portion 12 extending through opening 24 in wall 26. The automated banking machine of which housing 10 is a part includes a fascia generally indicated 32. Fascia 32 is sized for acceptance in covering relation with the front opening 14 of housing 12. Fascia 32 includes or provides access to customer actuatable components of the machine. These include for example a keypad, a card slot, a receipt form slot, a deposit accepting opening and a currency delivery opening. Fascia 32 further has mounted thereon or provides access to a display, function buttons and/or other components which provide input or output functions for a user operating the automated banking machine.

The automated banking machine further includes a surround 34. Surround 34 in the embodiment shown is a generally ring-shaped member. The surround provides a decorative feature and also serves the function of preventing unauthorized persons from accessing the fastening mechanisms which releasibly hold fascia 32 in engaged relation with the housing of the automated banking machine.

Figure 3:
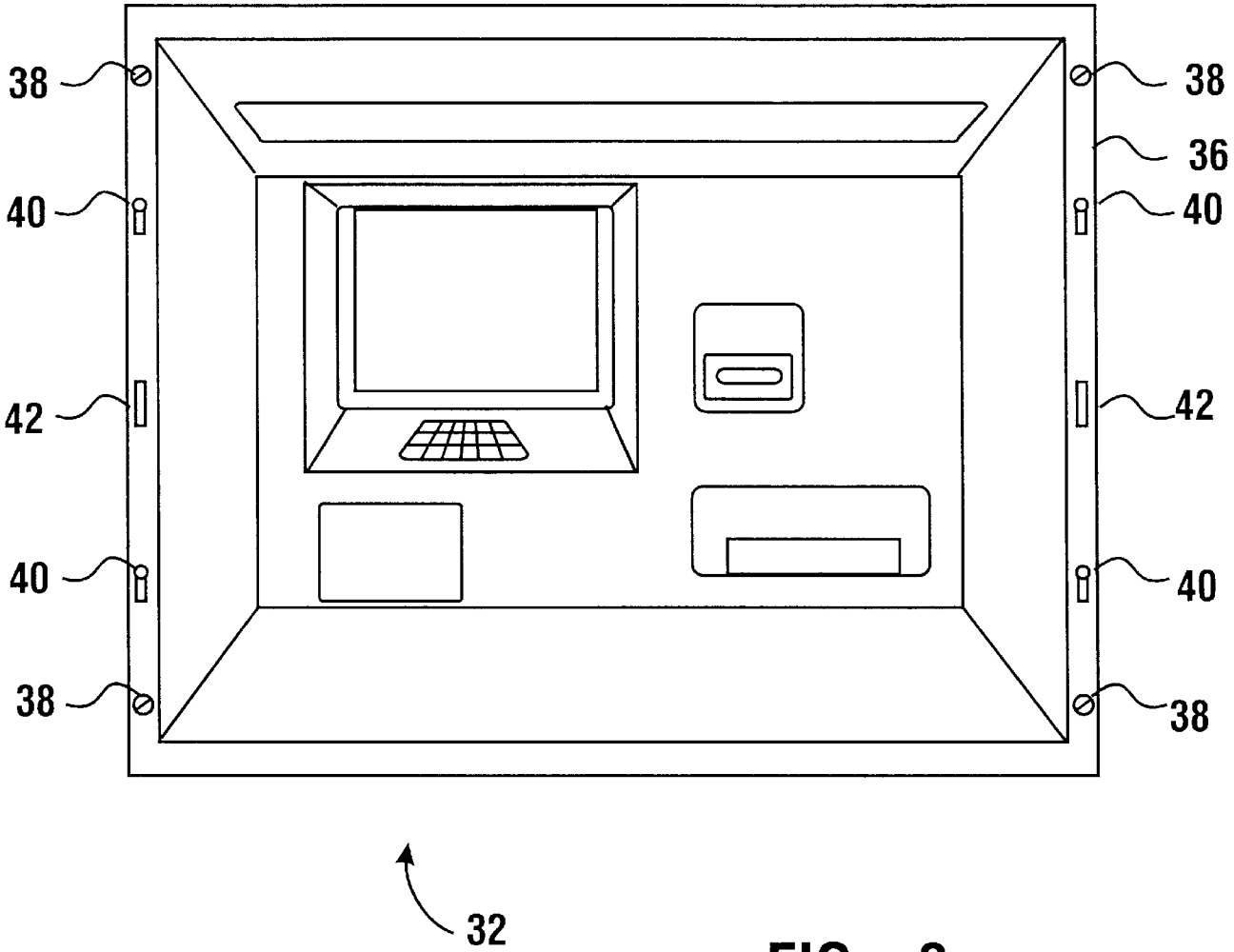
FIG. 3 is a front plan view of the fascia of the automated banking machine.

FIG. 3 shows fascia 32 in greater detail. Fascia 32 includes a perimeter area 36. Perimeter area 36 of the preferred embodiment extends on all four sides of the fascia. It should be understood that in other embodiments the perimeter area may extend on less than all sides. The perimeter area of the fascia in the operative connection is attached to the housing by fastening mechanisms 38. Fastening mechanisms 38 in the embodiment shown are screw type fasteners which engage the perimeter area of the fascia 32 to the housing. The fastening mechanisms 38 each include actuators, which in the case of the fasteners shown are the heads of the fasteners which may be manipulated so as to disengage the fastening mechanisms. When the fastening mechanisms are disengaged the fascia 32 may be removed from the front opening 14.

It should be understood that while in the embodiment described fastening mechanisms 38 hold the fascia directly to the housing, in other embodiments the fastening mechanisms may hold the fascia operatively engaged to the housing through intermediate members including wall 26.

Perimeter area 36 includes key slots 40. Key slots 40 comprise an opening with a vertically extending closed slot extending therefrom. The slot is somewhat smaller in width than the opening from which it extends. The purpose of the key slots is later discussed in detail. The perimeter area also includes bolt access openings 42.

Figure 6:
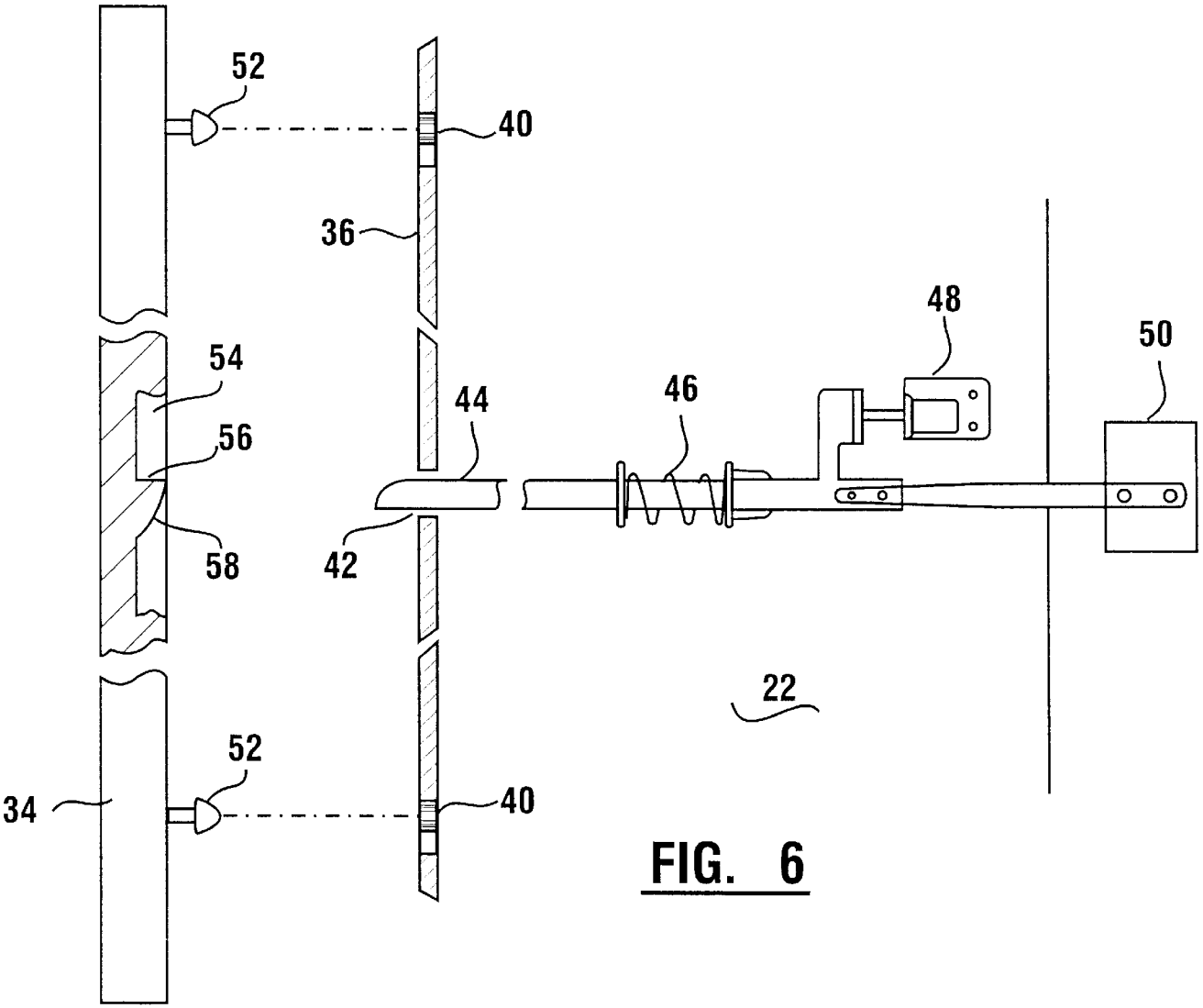
FIG. 6 is a partial side sectional view of the surround and latching mechanism with the surround separated from the fascia and housing.

As shown in FIG. 6 a movable bolt 44 extends through each bolt access opening 42. The bolt 44 extends in the interior area 22 of the housing. Each bolt 44 is biased to extend outwardly from the bolt access openings 42 by a spring 46 which is shown schematically. Bolt 44 is also attached to a holding mechanism 48. In the preferred embodiment of the invention holding mechanism 48 is a latch made by Southco. The holding mechanism provides for holding the bolt in a retracted position when the bolt is moved inwardly on a first occasion from an extended position. Thereafter when the bolt is moved inwardly when the bolt is in the retracted position, the holding mechanism releases, enabling the bolt to extend outwardly from opening 42 responsive to the force of spring 46. Of course, other releasible holding mechanisms may be used.

Figure 4:
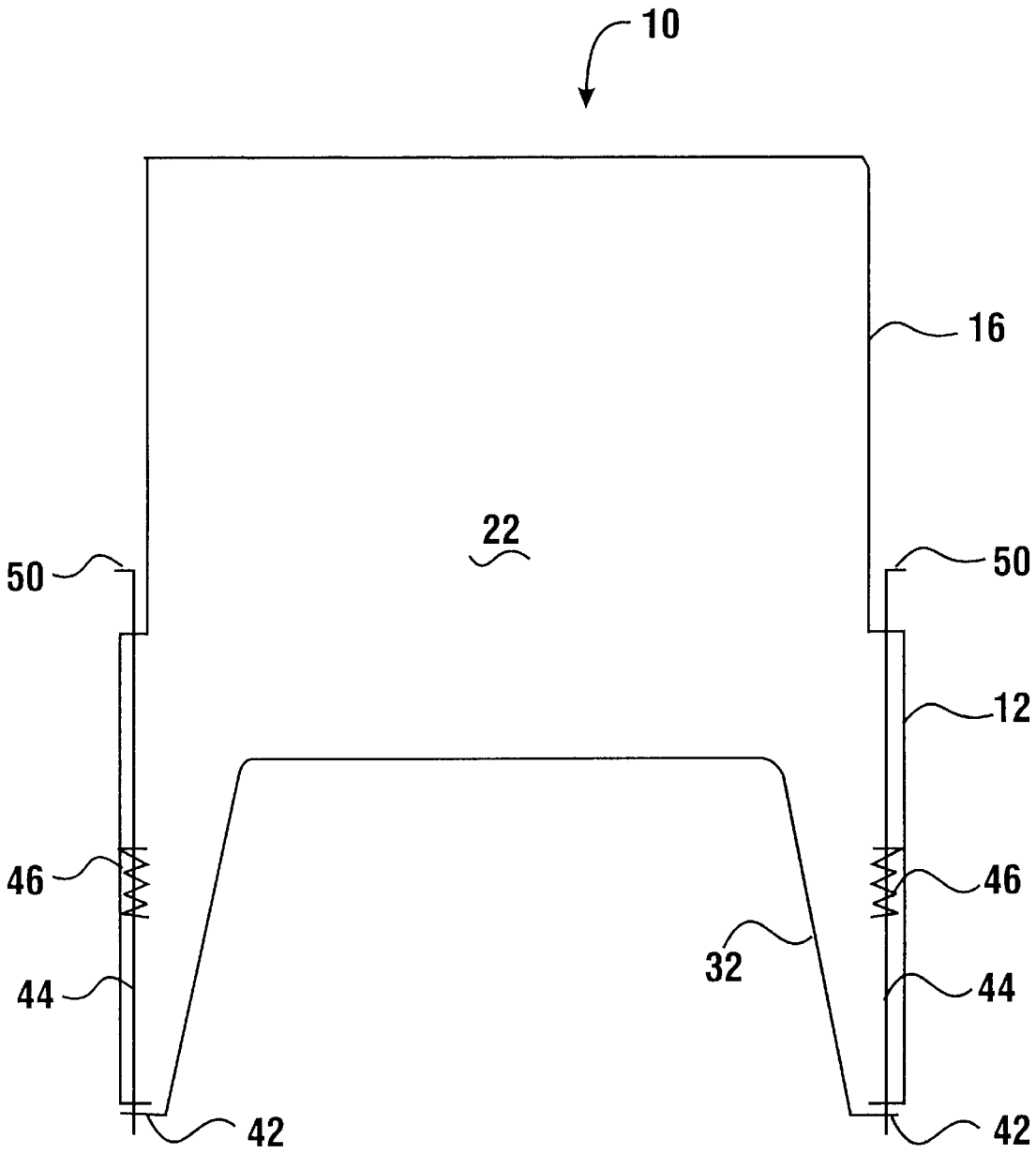
FIG. 4 is a top schematic view of the housing of the automated banking machine and the bolt used for holding the surround in position.
Figure 5:
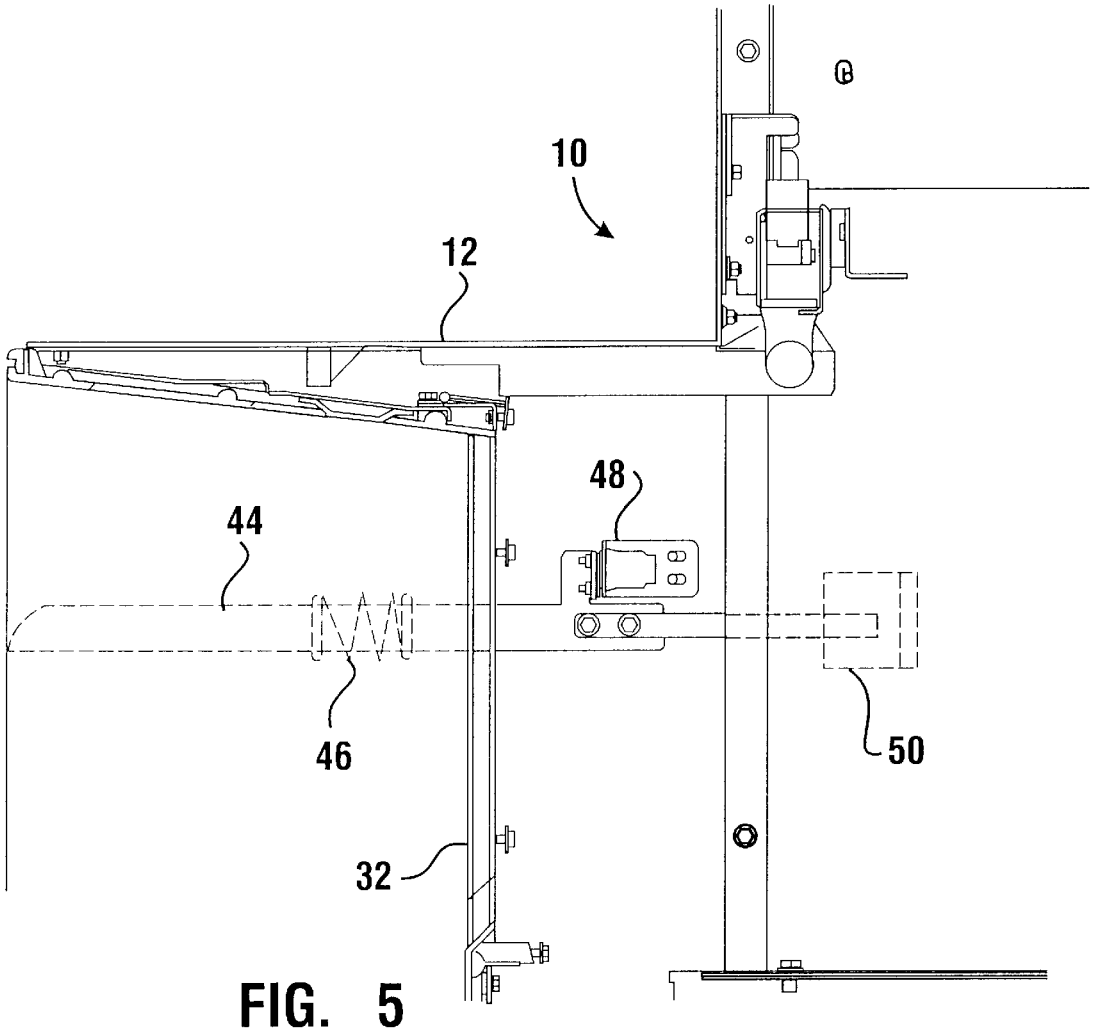
FIG. 5 is a partially sectioned schematic view of the housing and fascia of the automated banking machine.

Bolt 44 is connected to a handle 50. As shown in FIG. 4 bolts 44 extend through housing portion 12. Handles 50 are conveniently mounted on extension members which are attached to the bolts and which extend outside the housing 10 adjacent to the exterior of housing portion 16. This configuration enables a service person who wishes to gain access to the machine through the front opening to do so without otherwise having to first gain access to the interior area 22 of the machine. Alternatively a service person who has opened the access doors to housing 22 may manipulate the bolts from inside the interior area.

As shown in FIG. 6 the surround 34 includes inward extending posts 52. Posts 52 are sized for acceptance through the large openings of key slots 40. The heads of the posts are of sufficient size that when the surround is moved downward after the posts have been inserted through the key slots and the posts extend in the slotted portions, the posts are held in the slots and the surround cannot be moved away from the key slots unless it is first moved upward.

Surround 34 further includes an aperture 54. Aperture 54 is a recess of sufficient size to accept the outer end of bolt 44 therein. Aperture 54 is bounded by an aperture bounding surface 56. Surround 34 further includes a cam surface 58. Cam surface 58 extends on opposed side of surface 56 from aperture 54. Cam surface 58 is a generally smoothly contoured surface that extends to surface 56.

Figure 7:
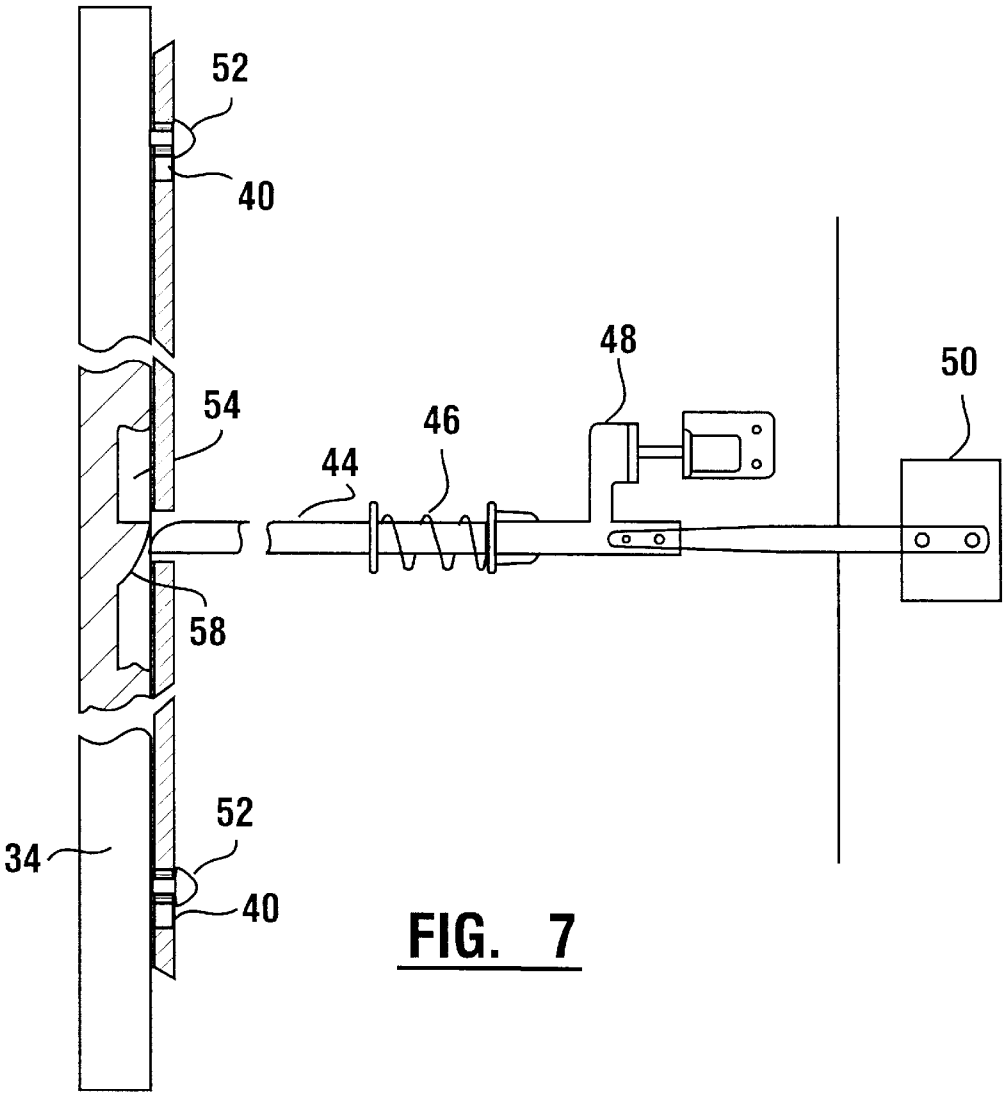
FIG. 7 is a view similar to FIG. 6 showing the surround being moved into latching engagement with the fascia and housing.

When the surround 34 is to be moved from the disengaged position shown in FIG. 6 to a position in which the surround is engaged with the fascia and the housing (and in overlying relation with fastening mechanisms 38), the surround 34 is moved to the position shown in FIG. 7. In the position shown in FIG. 7 posts 52 extend through the large openings of key slots 40. In this position the cam surface 58 engages the bolts 44 and biases each bolt to the right as shown against the force of springs 46. It should be noted that in this position the bolts 44 are not moved inward sufficiently such that the holding mechanisms 48 operate to hold the bolts in a retracted position.

Figure 8:
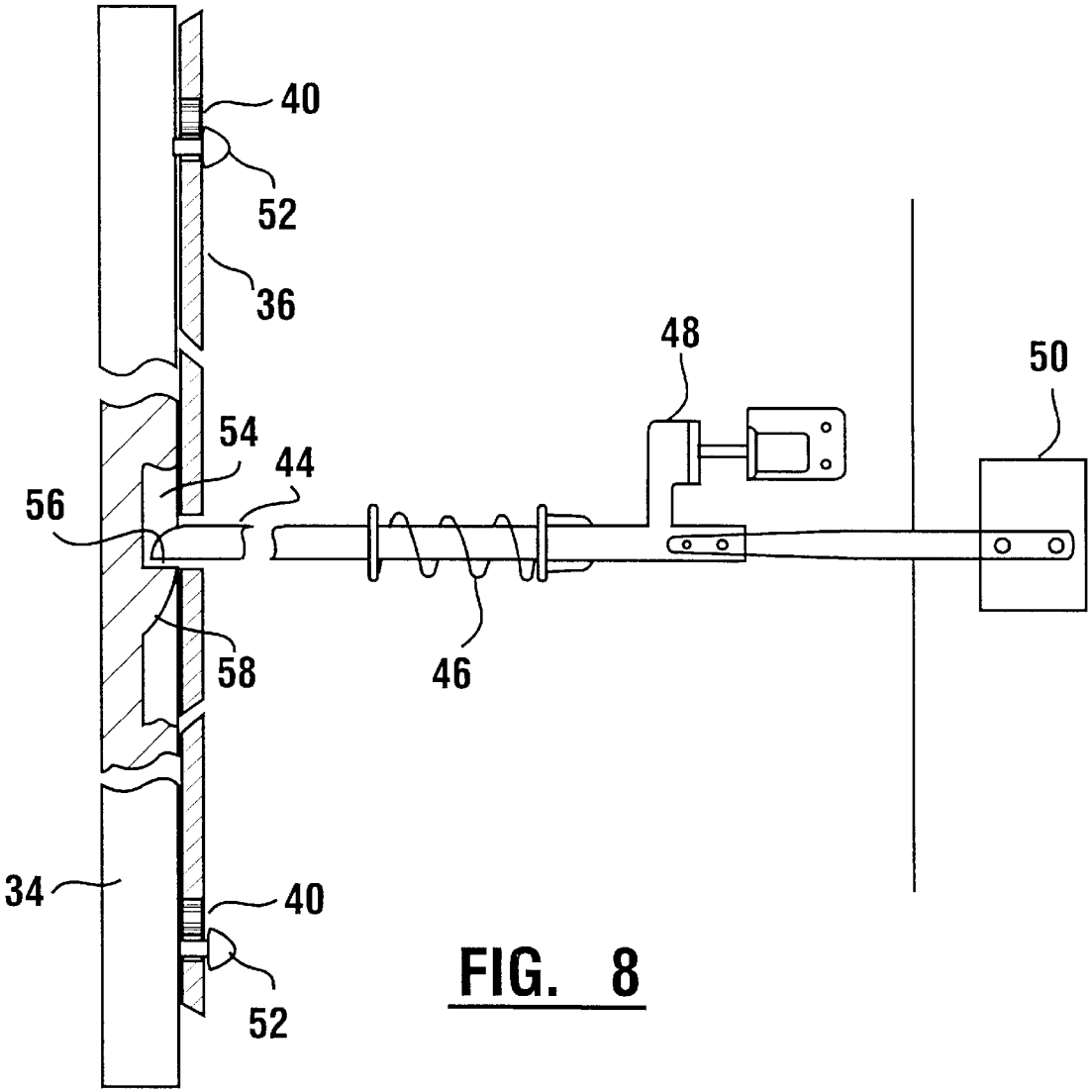
FIG. 8 is a view similar to FIG. 7 with the surround shown in latched engagement.

From the position of the surround 34 shown in FIG. 7, the surround is moved downward relative to the fascia and the housing, to the position shown in FIG. 8. In this position the posts are moved into the slotted portions of key slots 40. As the heads of posts 52 are larger than the slotted portions the surround is prevented from disengaging from the perimeter area 36 unless the surround 34 is moved relatively upward.

When the surround 34 is in the position shown in FIG. 8 upward movement of the surround is prevented by the bolts 44 which extend outward in response to the biasing force of springs 46. Bolts 44 move outward when surfaces 56 move to a position below the bolts. This enables the bolts to move outward into the apertures 54. The smoothly contoured cam surfaces 58 enable the surround to move downward in engagement with the bolts 44.

Once the surround is in the position shown in FIG. 8 the surround is prevented from moving upward by engagement of the bolts 44 with the aperture bounding surfaces 56. As a result the surround is maintained in covering, overlying relation with the actuators of fastening mechanisms 38. This prevents unauthorized persons from gaining access to the fastening mechanisms.

When a service person who is authorized to gain access to the interior area of the machine wishes to remove the fascia from the front opening 14, the handles 50 are pulled inward. This moves bolts 44 to a retracted position in which the bolts no longer extend into apertures 54. When the bolts are retracted, the holding mechanisms 48 hold the bolts in the retracted position. The service person is then enabled to travel to the exterior side of the wall and to remove the surround 34 by moving it upward from the position shown in FIG. 8. Once the posts 52 reach the enlarged openings of the key slots 40, the surround may be moved away from the fascia and the housing. Thereafter the fastening mechanisms 38 may be released and the fascia 32 removed from covering relation relative to the front opening 14. The service person may then access the serviceable components inside the interior area 22 of the ATM housing.

When the service person wishes to reinstall the fascia they have several options. The service person may return to the interior side of the wall and pull each of the handles rearward. This causes each holding mechanism to release the bolt 44 to move forward in response to the biasing force of spring 46. Alternatively if the service person has gained access to the interior area of the housing through the access opening in housing portion 20, they may pull the bolts rearward in the interior area of the housing so as to enable the bolts 44 to move forward. Finally the procedure which will be followed in most cases is that the service person will access the bolts through the front opening 14. Again pushing the bolts rearward causes the holding mechanism 48 to release the bolts to move forward in response to the biasing force of springs 46.

When both of the bolts are extended the fascia 32 may be reinstalled in the front opening 14. This is done by securing the fastening mechanisms 38. Thereafter the surround may be moved to the position shown in FIG. 7 and then moved downward to the position shown in FIG. 8. This causes the surround to be held in latched relation with the housing of the ATM. The surround remains in this position until it is again removed by an authorized person.

It should be understood that while in the preferred embodiment the posts are operatively attached to the surround and the key slots are operatively attached to the housing, in other embodiments the arrangements may be reversed. For example the posts may be operatively attached to the housing while the key slots are operatively attached to the surround. Likewise while in the preferred embodiment the latching mechanism is supported on the housing, in other embodiments the movable bolt may be provided on the surround. While in a preferred embodiment the surround is moved downward relative to the housing to hold it in position, and upward to remove. This may be reversed in other embodiments. Likewise in other embodiments the components may be configured to use relative transverse movement to move between held and released positions. Various modifications within the scope of the invention will suggest themselves to those skilled in the art from the foregoing description.

The preferred embodiment of the present invention provides a through the wall mounting for an automated banking machine that minimizes the risk of unauthorized persons gaining access to the interior area of the machine through removal of the fascia. However authorized service persons are readily enabled to gain access to the interior area by removing the surround and the fascia. This facilitates replacing the fascia or customer actuatable components mounted thereon. Being able to readily remove the fascia provides enhanced service access for serviceable components inside the housing of the machine.

Thus the preferred embodiment of the present invention achieves the above stated objectives, eliminates difficulties encountered in the use of prior devices, systems and methods, and attains the desirable results described herein.

In the foregoing description certain terms have been used for brevity, clarity and understanding. However no unnecessary limitations are to be implied therefrom because such terms are used for descriptive purposes and are intended to be broadly construed. Moreover the foregoing descriptions and illustrations are by way of examples and the invention is not limited to the details shown or described.

In the following claims any feature described as a means for performing a function shall be construed as encompassing any means capable of performing the recited function and shall not be limited to the means shown or described in the foregoing description as performing the recited function or mere equivalents thereof.

Having described the features, discoveries and principles of the invention, the manner in which it is constructed and operated and the new and useful results attained; the new and useful structures, devices, elements, arrangements, parts, combinations, systems, operations, methods and relationships are set forth in the appended claims.

I claim:

1. An automated banking machine apparatus comprising:

a housing bounding an interior area of the automated banking machine, the housing having a front opening;

a fascia, the fascia being in releasable covering relation with the front opening, wherein the fascia is held in covering relation with the front opening by a fastening mechanism, the fastening mechanism including an actuator, wherein the actuator is accessed to release the fastening mechanism;

a fascia surround wherein the surround is releasably operatively engageable with the housing, wherein when the surround is engaged with the housing the surround covers the actuator of the fastening mechanism;

a latching mechanism, wherein the latching mechanism releasably holds the surround in engagement with the housing, wherein the latching mechanism extends in the interior area and is changeable in the interior area from a latching condition in which the latching mechanism holds the surround in engagement with the housing to an unlatching condition wherein the surround is enabled to be operatively disconnected from the housing.

2. The apparatus according to claim 1 wherein the housing extends through an opening in a building wall, and wherein when the surround is engaged with the housing the surround is on an exterior side of the wall, and wherein the latching mechanism is changeable to the unlatching condition from an interior side of the wall.

3. The apparatus according to claim 1 wherein the latching mechanism includes an interengaging bolt and aperture, wherein one of either the bolt or aperture is in operative connection with the surround and the other of the bolt or aperture is in operative connection with the housing, and wherein in the unlatched condition the bolt is retracted out of the aperture.

4. The apparatus according to claim 3 wherein the latching mechanism further includes an interengaging post and key slot, wherein one of either the post or key slot is in operative connection with the surround and the other of the post or key slot is in operative connection with the housing, wherein the post and key slot move in a first direction relative to one another from a latching position before the surround is disengageable from the housing, and in the latched condition engagement of the bolt with a surface bounding the aperture limits relative movement of the post and key slot, wherein the surround and housing are prevented from being operatively disengaged.

5. The apparatus according to claim 3 and further comprising a spring biasing the bolt to extend in the aperture.

6. The apparatus according to claim 5 and further comprising a cam surface extending to intersect the surface bounding the aperture, wherein as the post and key slot move in a second direction opposed of the first direction toward the latching position the bolt is moved against the force of the spring by engagement of the bolt and the cam surface.

7. The apparatus according to claim 3 and further comprising a holding mechanism, wherein the holding mechanism selectively holds the bolt against the force of the spring and wherein the bolt is held in a position disposed out of said aperture.

8. The apparatus according to claim 3 and further comprising a handle in operative connection with the bolt, wherein the bolt is enabled to be moved by the handle, and wherein the handle extends outside the housing.

9. The apparatus according to claim 3 wherein the apparatus includes a holding mechanism in the housing, wherein the holding mechanism selectively holds the bolt in a retracted position against the force of the spring or alternatively in an extended position wherein the bolt is enabled to be moved by the spring to engage in the aperture, and wherein the holding device is accessible through the front opening when the fascia is removed therefrom.

10. The apparatus according to claim 3 wherein the housing includes a first portion, wherein the first portion extends through a building wall, and wherein the surround is engageable with the first portion, and wherein when the surround is engaged with the first portion the surround is on an exterior side of the wall, and further comprising a second housing portion, wherein the second housing portion is on an interior side of the wall, and further comprising a handle in operative connection with the bolt, wherein the bolt is movable by the handle and wherein the handle is accessible from outside the second housing portion on the interior side of the wall.

11. An automated banking machine apparatus comprising:

a housing bounding an interior area of an automated banking machine, the housing including a front opening;

a fascia positioned in overlying relation of the front opening, the fascia having a perimeter area;

a surround positioned in overlying relation with the perimeter area of the fascia;

a latching mechanism releasably holding the surround in overlying relation with the perimeter area of the fascia, the latching mechanism including a movable member extending in the interior area, and wherein movement of the movable member releases the surround to be moved from the position overlying the perimeter area.

12. The apparatus according to claim 11 and further comprising fasteners holding the fascia in engagement with the housing, wherein the fasteners extend in the perimeter area, and wherein when the surround is in overlying relation with the perimeter area the surround area also overlies the fasteners.

13. The apparatus according to claim 11 and further comprising a building wall and wherein the housing extends through an opening in the building wall, and wherein the surround and the handle are positioned on opposed sides of the wall.

14. The apparatus according to claim 11 wherein the member is biased by a spring toward a first position wherein the member is operative to hold the surround in engaged position with the housing, and further comprising a holding mechanism wherein the holding mechanism is selectively operative to hold the member in a second position wherein the surround is enabled to be disengaged from the housing, and wherein the member is in operative connection with a handle outside the housing, wherein the member is movable from the first position to the second position by moving the handle outside the housing, and the member is movable from the second position to the first position by moving the member inside the housing.

15. The apparatus according to claim 14 wherein the member is movable from the second position to the first position by accessing the member through the front opening when the fascia is removed therefrom.

16. A method comprising the steps of:

(a) releasing a latching mechanism by moving a member extending in an interior area of a housing of an automated banking machine, wherein releasing the latching mechanism renders a surround movable relative to the housing;

(b) moving the surround, wherein moving the surround renders accessible an actuator of a fastening mechanism, wherein the fastening mechanism releasably holds a fascia in covering relation of a front opening of the housing;

(c) releasing the fastening mechanism by manipulating the actuator; and (d) moving the fascia, wherein the fascia no longer covers the front opening of the housing.

17. The method according to claim 16 wherein the housing extends through an opening in a building wall, and wherein the member is in operative connection with a handle on an interior side of the wall, and wherein the surround prior to step (b) is positioned on an exterior side of the wall, and wherein step (a) includes moving the handle on the interior side of the wall.

18. The method according to claim 17 wherein the machine includes a holding mechanism, and wherein the member comprises a bolt, and wherein step (a) further includes moving the bolt to a retracted position and holding the bolt in the retracted position with a holding mechanism.

19. The method according to claim 17 wherein step (a) includes moving the member out of an aperture in the surround.

20. The method according to claim 16 wherein step (b) includes moving a post in operative connection with the surround relative to a key slot in operative connection with the housing.

* * * * *